US008334019B2

(12) United States Patent
Benwadih et al.

(10) Patent No.: US 8,334,019 B2
(45) Date of Patent: Dec. 18, 2012

(54) METHOD FOR DEPOSITING A MATERIAL ONTO THE SURFACE OF AN OBJECT

(75) Inventors: Mohamed Benwadih, Grenoble (FR); Marie Heitzmann, Sinard (FR); Jean-Marie Verilhac, Grenoble (FR)

(73) Assignee: Commissariat à l'Energie Atomique, Paris (FR)

( * ) Notice: Subject to any disclaimer, the term of this patent is extended or adjusted under 35 U.S.C. 154(b) by 417 days.

(21) Appl. No.: 12/635,768

(22) Filed: Dec. 11, 2009

(65) Prior Publication Data

US 2010/0183806 A1 Jul. 22, 2010

(30) Foreign Application Priority Data

Jan. 19, 2009 (FR) ..... 09 50301

(51) Int. Cl.
*B05D 3/02* (2006.01)
*B05D 1/34* (2006.01)
*B05D 1/36* (2006.01)

(52) U.S. Cl. ..... 427/379; 427/98.3; 427/99.2; 427/202; 427/372.2

(58) Field of Classification Search ..... 427/97.1, 427/98.4, 202, 220, 221, 226, 372.2, 384, 427/379, 98.3, 99.2
See application file for complete search history.

(56) References Cited

U.S. PATENT DOCUMENTS

| | | | | |
|---|---|---|---|---|
| 4,849,264 | A * | 7/1989 | Pekar et al. | 427/388.1 |
| 5,102,699 | A | 4/1992 | Beeson et al. | |
| 6,090,446 | A * | 7/2000 | Nakashima et al. | 427/277 |
| 2006/0078893 | A1 * | 4/2006 | Griffiths et al. | 435/6 |
| 2006/0113510 | A1 * | 6/2006 | Luo et al. | 252/500 |

OTHER PUBLICATIONS

Material Safety Data Sheet of Perfluoro-compound liquid FC 75 (trademark: Fluorinert FC 75 from Dupont).*
Material Safety Data Sheet of Perfluoro-compound liquid FC 75 (trademark: Fluorinert FC 75 from Dupont). Oct. 9, 1998.*
Republique Francaise, Rapport De Recherche Preliminaire, dated Sep. 8, 2009, 2 pgs in French language.

* cited by examiner

*Primary Examiner* — Michael Cleveland
*Assistant Examiner* — Alexander Weddle

(57) ABSTRACT

The invention relates to a method of depositing a layer of material onto the surface of an object, of the type comprising the deposition of a layer of solution of said material in a first liquid followed by the evaporation of the first liquid to form the layer of material. According to the invention, the method comprises the formation of a layer of a second liquid interposed between the object and the layer of solution, the second liquid being immiscible with the first liquid, of density greater than that of the first liquid and with an evaporating temperature higher than that of the first liquid.

8 Claims, 2 Drawing Sheets

METHOD FOR DEPOSITING A MATERIAL ONTO THE SURFACE OF AN OBJECT

CROSS REFERENCE TO RELATED APPLICATIONS

This application claims priority under 35 U. S. C. §119 from French Patent Application No. 0950301 filed on Jan. 19, 2009 in the French Patent Office, the entire disclosure of which is incorporated herein by reference.

FIELD OF THE INVENTION

The invention relates to the field of electronics, and, to be more specific, to the field of the deposition, and in particular the wet deposition, of a material onto the surface of an object, such as a substrate for example. The invention can be used most specifically in the wet deposition of organic materials, but it may also be applied to the deposition of inorganic materials.

BACKGROUND OF THE INVENTION

Microelectronics conventionally developed around inorganic materials such as silicon (Si) or gallium arsenide (GaAs). Another route is currently being explored around organic materials, such as polymers, on account of their suitability for large-scale manufacture, their mechanical strength, their flexible structure or even their suitability for re-processing. Screens have thus been designed based on organic diodes (OLEDs) or based on organic thin film transistors (OTFTs). Additionally, the use of layer deposition techniques, by spin-coating for example, by ink jet or by screen printing, is made possible through the use of soluble polymers.

However the deposition of organic material presents a certain number of difficulties. To be more specific, getting a good quality conductive organic layer on a substrate surface is difficult. Indeed, a conductive organic layer is obtained by means of organic crystalline materials. These have, unlike amorphous materials which have a random molecular organization, thereby entailing difficult electronic transmission and therefore poor electrical conduction, a periodic molecular structure that affords reliable and controlled electrical conduction.

However, by studying the electrical properties of a thin layer of crystalline polymer that has been deposited wet for example, on the surface of a substrate, generally speaking chaotic and unpredictable electric current conduction is observed instead of it offering the expected good electrical conductivity.

Indeed, the usual techniques of forming a layer of organic material (ordinarily the deposition of a solution comprising said material diluted in a solvent, followed by the evaporation of the solvent leading to the formation of a layer of crystallized material) not generally allow homogeneous growth of the crystal network on account of the non-homogeneity of the substrate surface. For example, the substrate surface has rough patches, a non-homogeneous surface energy, steps or again functional elements such as metal connections for example.

Additionally, non-crystalline organic materials also pose problems when they are deposited also on account of the non-homogeneity of the substrate surface, such as wettability breakdown or stepway problems.

SUMMARY OF THE INVENTION

The purpose of the present invention is to resolve the aforementioned problems by proposing a method of depositing a layer of material, organic or not, onto the surface of an object, and in particular a substrate, whereof the quality is substantially independent of the state of the object surface.

To this end the object of the invention is the deposition of a layer of material onto the surface of an object, of the type that comprises the deposition of a layer of solution of said material in a first liquid, followed by the evaporation of the first liquid to form the layer of material.

According to the invention, the method comprises the formation of a layer of a second liquid interposed between the object and the layer of solution, the second liquid being immiscible with the first liquid, of density greater than that of the first liquid, and with an evaporating temperature higher than that of the first liquid.

Solution is taken to mean in particular either a dissolution of the material in a solvent, or a dispersion of nanoobjects in a dispersing agent.

In other words, the solution constituted by the material and by the first liquid is formed on the surface of a "carpet" of the second liquid, said carpet being for its part deposited onto the surface of the object. Given the immiscibility of the first and second liquids, the interface between the two liquids has a homogeneous surface, said homogeneity being independent of the state of the object surface. If said surface is not perfectly homogeneous, it will however be noted that its non-uniformity is molecular in nature, a dimension not accessible with current techniques. It will thus be noted that the surface of the substrate may have large disparities in energy (caused for example by the presence of different materials) or in geometry (rough patches, steps, dust, etc.) without this having a direct effect upon the quality of the crystal formed on the surface of the object when there is crystallization or quite simply on the quality of the deposition carried out.

Such homogeneity is additionally suitable for the homogeneous growth of the crystal of a crystalline organic material when the first liquid is evaporated. A crystal network of great homogeneity is thus obtained on the surface of the object after evaporation of the second liquid.

According to some embodiments of the invention, the method comprises one or more of the following features.

Thus, the material to be deposited is not soluble in the second liquid.

The second liquid layer is formed by depositing it onto the object prior to the deposition of the solution layer.

A mixture, comprising the material and the first and second liquids, is deposited onto the surface of the object, the second liquid layer being formed by de-mixing and phase separation.

The second liquid is denser than the first liquid by at least 0.2 mg/l.

The evaporating temperature of the second liquid is higher than the evaporating temperature of the first liquid by at least 20 degrees.

The solution includes the material dissolved in a solvent. To be more specific, the solvent is toluene and the second liquid is a fluorinated liquid, or the solvent is toluene and the second liquid is water.

The solution includes the material in the form of nanoobjects dispersed in a dispersing agent. In particular, the nanoobjects are nanowires or nanotubes, the dispersing agent is alcohol and the second liquid is a fluorinated liquid.

BRIEF DESCRIPTION OF THE FIGURES

The invention will be better understood from reading the following description, given solely by way of example, and produced in relation to the appended drawings wherein.

EMBODIMENTS OF THE INVENTION

A method will be described with the help of FIGS. 1 to 4 of depositing a layer of material according to the invention.

Figure 1:
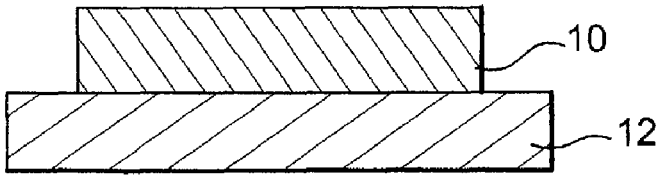
FIGS. 1 to 4 are diagrammatic cross-section views illustrating the steps in a method of depositing onto an overall plane surface according to the invention.

During a first step, a mixture 10, comprising a first liquid, a second liquid and a material for deposition, is deposited by wet deposition onto the surface of a substrate 12 (FIG. 1).

The mixture 10 is for example prepared by mixing a first solution, comprising the material made soluble in the first liquid, and the second liquid, the latter not making the material soluble.

Figure 2:
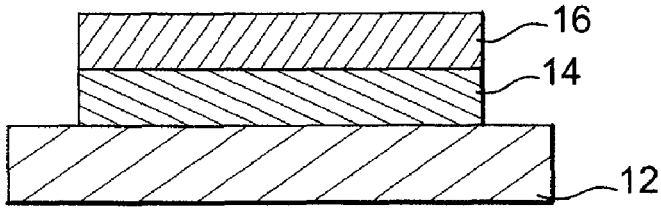

Moreover, the second liquid is selected to be immiscible with the first liquid and denser than it, so that a de-mixing and phase separation process occurs. The second liquid then takes the form of a layer 14 on the surface of the substrate 12, the first liquid with the material then taking for its part the form of a layer 16 on the surface of the layer 14 of the second liquid (FIG. 2).

Furthermore, the second liquid is also selected to have an evaporating temperature higher than that of the first liquid so that, when the first liquid evaporates, the second liquid does not evaporate.

Similarly, the mixture 10 is for example prepared by mixing nanoobjects with a first dispersing agent and the second liquid, the latter not creating a single phase with the first dispersing agent.

Figure 3:
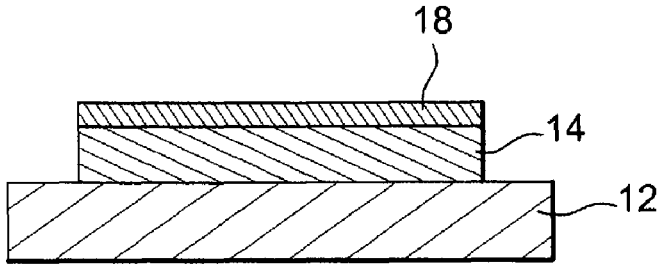

Thus, once the de-mixing and phase separation phase process is complete, the inventive method is continued by heating the assembly constituted by the substrate 12 and the layers 14 and 16 to a temperature higher than or equal to the evaporating temperature of the first liquid and lower than the evaporating temperature of the second liquid. During this evaporation, the material contained in the layer 16 is deposited and a layer of material 18 is thus finally obtained on the surface of the layer 14 of the second liquid (FIG. 3). If the material is conducive to crystallizing, a layer of crystallized material is thus obtained.

Figure 4:
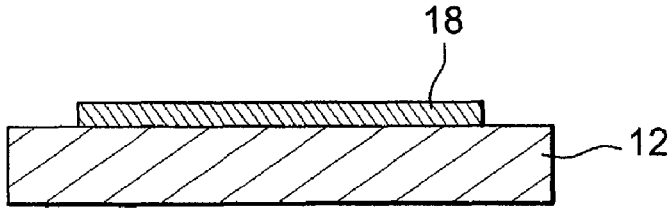

Once the layer 18 is obtained, a second heating phase is implemented bringing the assembly constituted by the substrate 12 and the layers 14 and 18 to a temperature higher than or equal to the evaporating temperature of the second liquid. The layer 14 of the second liquid then evaporates so that the layer 18 of material is deposited on the surface of the substrate 12 and, if need be, finishes drying (FIG. 4).

As an alternative, rather than depositing a mixture 10 comprising both the material and the first and second liquids, a layer of the second liquid is deposited on the surface of the substrate 12, and then a layer of solution comprising the organic material and the first substrate is deposited on the liquid layer of the second liquid.

Figure 5:
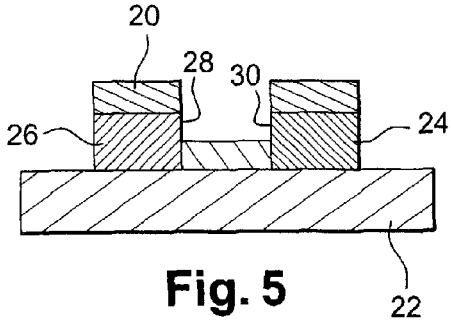
Fig. 5 PRIOR ART
FIG. 5 shows a prior art stepway defect.

FIG. 5 shows a frequent case of difficulties encountered in the prior art when depositing a layer 20 of solution of a material, crystalline or amorphous, onto a substrate 22 comprising elements 24, 26 forming projections on the surface thereof. Ordinarily, by evaporating the solvent from the solution, deposition fractures appear in the stepways 28, 30.

Figure 6:
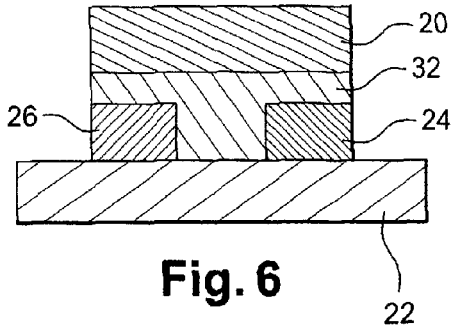
FIGS. 6 and 7 show the way in which the invention resolves such stepway defects.
Figure 7:
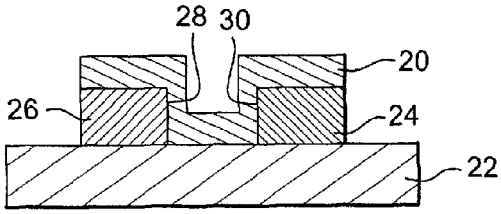

According to the invention, a layer 32 of a second liquid, immiscible and denser than the first liquid, is deposited, filling the space between the substrate 22 and the layer 20 so as to encompass the elements 24, 26 (FIG. 6), as has been previously described. Next, by evaporating off in succession the first liquid and the second liquid, which has an evaporating temperature higher than that of the first liquid, a layer 20 of material is obtained that has no fracture in the stepways 28, 30. Indeed, when the layer of organic material 20 subsides on account of the evaporation of the layer 24 of the second liquid, it is already substantially dry with the result that it does not break.

Figure 8:
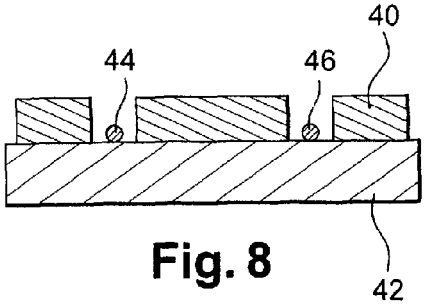
FIG. 8 shows a prior art wettability defect produced by the presence of a surface defect.

FIG. 8 shows another frequent case of difficulties encountered in the prior art during the direct deposition of a solution 40 of material in a solvent onto the surface of a substrate 42. When said surface comprises imperfections 44, 46, like dust or rough patches for example, the layer 40 of solution de-wets thereon. This type of defect is particularly sensitive when the layer of material performs an electrical insulation function since the result is an increase in leakage currents, and in a general way a reduction in electrical performance.

Figure 9:
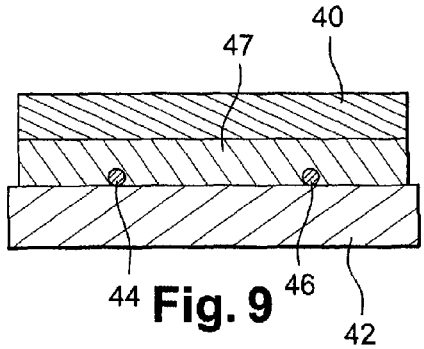
FIGS. 9 and 10 show the way in which the invention resolves such wettability defects.
Figure 10:
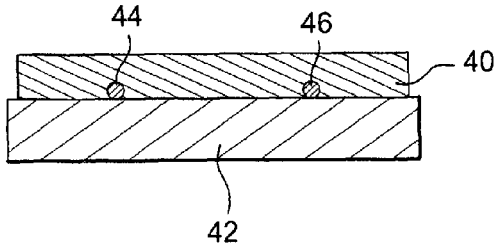

By forming a layer 47 of second liquid between the substrate 42 and the layer 40 (FIG. 9), and then by proceeding to evaporate in succession the first and second liquids, a layer of material is obtained in which the surface defects 44, 46 are buried (FIG. 10).

According to the invention, the second liquid is immiscible with the first liquid, and denser than it and has a higher evaporating temperature.

Preferably, the second liquid is denser by 0.2 mg/l than the first liquid and has a higher evaporating temperature than that of the first liquid by at least 20° C. Below these values, the inventors have observed that the quality of the deposition of the material onto the surface of the substrate substantially deteriorates.

Preferably, the first liquid is toluene and the second liquid is a fluorinated liquid, and preferentially perfluoropolymer, or the first liquid is toluene and the second liquid is water. The inventors have indeed noted that these combinations allow the formation of a quality "carpet" for the material for deposition and the formation of a quality layer of material, and in particular when this is of the semi-conductor type.

The first and second liquids may however be selected as a function of the intended use from:

- conductive solvents, such as for example doped polyaniline, polyethylene dioxythiophene-doped polystyrene sulfonate (PDOT-PSS), indium and tin oxide (ITO) or inks, i.e. nanoparticles of metal, such as silver for example, in a solvent, such as ethylene glycol;
- semi-conductor solvents, such as for example polyaniline, PDOT-PSS, modified pentacene (TIPS), the polythiophenes (for example poly-3-hexylthiophene (P3HT)) or the polyacetylenes;
- dielectric solvents, such as for example polyvinylphenol (PVP), polymethyl methacrylate (PMMA), methylsilsesquioxane (PMMSQ), polyimide, the fluoropolymers (PVDF) or perfluoropolymers (PTFE);
- polar solvents, such as for example hexane, benzene, toluene, diethyl ether, chloroform, or ethyl acetate;
- polar aprotic solvents, such as for example 1-4 dioxane, tetrahydrofuran (THF), dichloromethane (DCM) or acetone;
- dispersing agents for nanoobjects (for example silicon nanowires, carbon nanotubes or nanoparticles), such as water or alcohol.

By means of the invention, the following advantages are thus obtained in particular:

an independence of the formation of the layer of material relative to the surface onto which it is deposited. Said surface, belonging to any object, such as a metal or plastic substrate for example, may thus present a non-uniformity such as variations in energy, rough patches, dust or elements forming a projection; and when the material is to be crystallized for the purpose of obtaining a crystalline layer of good electrical quality, a homogeneous crystallization surface formed by the interface between the immiscible liquids.

The invention claimed is:

1. A method for depositing a layer of material onto a surface of an object, the method comprising:

depositing a layer of solution of said material solubilized in a first liquid;

forming a layer of a second liquid interposed between the object and the layer of solution, the second liquid being immiscible with the first liquid and of density greater than that of the first liquid;

evaporating the first liquid to form the layer of material by heating said solution and said second liquid to a first evaporating temperature suitable for evaporating said first liquid from said solution and depositing said material onto a surface of said second liquid; and heating said material and said second liquid to a second evaporating temperature higher than the first evaporating temperature.

2. The method as claimed in claim 1, wherein the material is not soluble in the second liquid.

3. The method as claimed in claim 1, wherein the layer of the second liquid is formed by the deposition thereof onto the object prior to the deposition of the layer of solution.

4. The method as claimed in claim 1, wherein a mixture comprising the material and the first and second liquids is deposited onto the surface of the object, the layer of the second liquid being formed by de-mixing and phase separation.

5. The method as claimed in claim 1, wherein the second liquid is denser than the first liquid by at least 0.2 mg/l.

6. The method as claimed in claim 1, wherein the second evaporating temperature is higher than the first evaporating temperature by at least 20 degrees C.

7. The method as claimed in claim 1, wherein the material is dissolved in toluene and the second liquid is a fluorinated liquid.

8. The method as claimed in claim 1, wherein the material is dissolved in toluene and the second liquid is water.

* * * * *